US006099361A

United States Patent [19]

Takanashi

[11] Patent Number: 6,099,361

[45] **Date of Patent: *Aug. 8, 2000**

[54] CONNECTOR FOR A PRINTED CIRCUIT BOARD OR AN ELECTRIC OR ELECTRONIC DEVICE

[75] Inventor: Hitoshi Takanashi, Yokkaichi, Japan

[73] Assignee: Sumitomo Wiring Systems, Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/073,727

[22] Filed: May 7, 1998

[30] Foreign Application Priority Data

May 9, 1997 [JP] Japan ..... 9-119381

[51] Int. Cl.[7] ..... H01R 10/42

[52] U.S. Cl. ..... 439/751; 437/844

[58] Field of Search ..... 439/751, 873, 439/595, 752.5, 851, 857, 849, 382, 383, 384, 385, 842, 843, 844, 846

[56] References Cited

U.S. PATENT DOCUMENTS

| | | | |
|---|---|---|---|
| 2,834,951 | 5/1958 | Aquillon et al. | 439/345 |
| 3,609,640 | 9/1971 | Longenecker et al. | 439/709 |
| 4,900,271 | 2/1990 | Colleran et al. | 439/595 |
| 4,966,557 | 10/1990 | Barkus et al. | 439/246 |
| 5,249,980 | 10/1993 | Hatagishi | 439/398 |
| 5,362,262 | 11/1994 | Hotea | 439/839 |
| 5,389,013 | 2/1995 | Kourimsky | 439/746 |
| 5,641,314 | 6/1997 | Broschard, III et al. | 439/751 |
| 5,741,162 | 4/1998 | Kourimsky et al. | 439/748 |
| 5,755,599 | 5/1998 | Hotea | 439/745 |

FOREIGN PATENT DOCUMENTS

| | | |
|---|---|---|
| 0 725 460 | 8/1996 | European Pat. Off. . |
| 0 828 317 | 3/1998 | European Pat. Off. . |
| 3-11566 | of 1991 | Japan . |

*Primary Examiner*—Gary F. Paumen
*Assistant Examiner*—Ross Gushi
*Attorney, Agent, or Firm*—Anthony J. Casella; Gerald E. Hespos; Michael J. Porco

[57] ABSTRACT

A female terminal fitting 20 is provide to prevent solder portions from shaking in a connector for a printed circuit board. The female terminal fitting 20 includes a connection portion 21, a board connection piece 22 continuously connected with the rear end of the connection portion 21 and a solder portion 22A formed at the end of the board connection piece 22. A pair of elastic holding portions 23 extend from opposite sides of the rear end of the connection portion 21. When the terminal fitting 20 is mounted into a terminal cavity 11, the elastic holding portions 23 are brought into contact with the inner walls of the terminal cavity 11 by their elastic force. As a result, displacement of the terminal fitting 20 and shaking of the solder portion 22B can be prevented.

3 Claims, 4 Drawing Sheets

CONNECTOR FOR A PRINTED CIRCUIT BOARD OR AN ELECTRIC OR ELECTRONIC DEVICE

BACKGROUND OF THE INVENTION

1. Field of the Invention

The present invention relates to a connector to be mounted on a printed circuit board or an electric or electronic device.

2. Description of the Prior Art

A connector to be mounted on a printed circuit board is disclosed in Japanese Unexamined Patent Publication No. 3-11566. This prior art connector is constructed, as shown in FIG. 6, such that female terminal fittings 3 are mounted in terminal cavities 2 formed in a connector housing 1. Each female terminal fitting 3 has a box-shaped connection portion 4 to be connected with an unillustrated male terminal fitting and a strip-shaped board connection piece 5 extending outwardly of the connector housing 1 from the rear end of the connection portion 4. The board connection piece 5 is formed with a solder portion 5*a* which is inserted into an insertion hole 6*a* formed in a printed circuit board 6 and soldered to conductive regions on the circuit board 6. A deformation permitting portion 5*b* is formed between the solder portion 5*a* and the connection portion 4 to reduce a stress on the solder portion 5*a* during the engagement and disengagement with and from a mating connector. Elastic deformation of the deformation permitting portion 5*b* thereby prevents a solder crack.

With the above construction, the female terminal fittings 3 move relatively freely in the terminal cavities 2 because they are held by lances or engaging portions 7 upon being inserted into the terminal cavities 2. Thus, the female terminal fittings 3 may be displaced from their proper position when the connector is mounted on the printed circuit board 6, and the solder portions 5*a* of the board connection pieces 5 cannot be inserted accurately into the corresponding insertion holes 6*a*. As a result, the deformation permitting portions 5*b* may be struck against the printed circuit board 6, thereby being buckled.

In view of the above problem, an object of the present invention is to provide a connector for a printed circuit board or an electric or electronic device which allows for an easy and secure insertion of the terminal fittings into the terminal cavities.

SUMMARY OF THE INVENTION

According to the invention, there is provided a connector for a printed circuit board or an electric or electronic device. The connector comprises a connector housing formed with one or more terminal cavities. One or more terminal fittings are insertable into the corresponding terminal cavities. Each terminal fitting comprises a connection portion that is connectable with a mating terminal fitting. A device connection piece extends from the connection portion and is loosely movable or longitudinally and/or laterally deflectable or elongateable with respect to the corresponding terminal cavity. A solder or fixing portion can be soldered or fixed to the printed circuit board or the electric or electronic device. Each terminal fitting is provided with at least one elastic holding portion which is brought or which can be brought substantially elastically into contact with the inner wall of the corresponding terminal cavity to position the terminal fitting substantially correctly with respect to the terminal cavity. The elastic holding portion also may substantially align the fixing portion with an insertion opening or recess on the printed circuit board or on the electric or electronic device preferably to prevent an unwanted displacement of the terminal fitting.

Accordingly, the connector preferably can prevent a difficulty in substantially inserting solder fixing portions of terminal fittings into insertion holes formed in the printed circuit board or an electric or electronic device due to the displacement of the terminal fittings in terminal cavities.

According to a preferred embodiment of the invention, there is provided a connector for a printed circuit board, comprising a connector housing formed with terminal cavities. Terminal fittings are insertable into the terminal cavities. Each terminal fitting comprises a connection portion connectable with a mating terminal fitting. A board connection piece extends from the connection portion and is loosely movable with respect to the corresponding terminal cavity. A solder portion is provided at the leading end of the board connection piece and can be soldered to the printed circuit board. Each terminal fitting is provided with an elastic holding portion which is elastically brought into contact with the inner wall of the corresponding terminal cavity to prevent displacement of the terminal fitting.

Accordingly, with the terminal fittings mounted in the terminal cavities of the connector housing, the elastic holding portions are elastically in contact with the inner walls of the terminal cavities. As a result, the displacement of the terminal fittings in the terminal cavities is prevented, so that the solder portions can be inserted securely into the insertion holes of the printed circuit board.

Preferably, a pair of elastic holding portions are so provided at an end adjacent to the connection portion, and preferably the rear end of the connection portion so as to substantially face each other. The elastic holding portions are substantially brought into contact with opposite inner walls of the corresponding terminal cavity. Accordingly, since each pair of elastic holding portions extends between the inner walls of the terminal cavity to be in contact therewith, the terminal fitting can be held stably.

The elastic holding portion is formed with at least one bead, which preferably is to be brought into contact with the inner wall of the corresponding terminal cavity. Accordingly, since the beads project from the elastic holding portions, they are brought strongly into contact with the inner walls of the terminal cavities, thereby further increasing a terminal fitting holding force.

Still further preferably, the device connection piece comprises a deformation permitting portion, which preferably is provided with a weakened portion such as a recess and/or a slit. Accordingly, the device connection piece is more easily moveable or longitudinally and/or laterally deflectable or elongateble. This effectively avoids a relative movement of the fixing portion with respect to the printed circuit board or the like upon engagement and/or disengagement of the terminal fitting and the mating terminal fitting.

According to a further preferred embodiment, the pair of elastic portions are bent towards each other or are bent inwardly such that at least their distal ends come substantially into contact when the terminal fitting is inserted into the corresponding terminal cavity. Accordingly, the terminal fitting can be stably held in the terminal cavity.

Preferably, the terminal fitting comprises at least one lock hole to be engageable with an engaging portion of the connector housing when the terminal fitting is inserted into the corresponding terminal cavity. Thus the terminal fitting is substantially locked or fixed along a longitudinal direction thereof or an insertion direction. Accordingly, the terminal fitting can be secured easily in the terminal cavity along a longitudinal direction thereof.

Most preferably, the fixing portion is provided substantially at the leading end of the device connection piece.

These and other objects, features and advantages of the present invention will become more apparent upon a reading of the following detailed description.

DETAILED DESCRIPTION OF THE PREFERRED EMBODIMENT

A first embodiment of a connector for a printed circuit board according to the invention is illustrated in FIGS. 1 to 4. The connector according to this embodiment is comprised of a connector housing 10 in which a plurality of terminal cavities 11 are formed substantially side by side. Female terminal fittings 20 are mounted in the respective terminal cavities 11.

Figure 1:
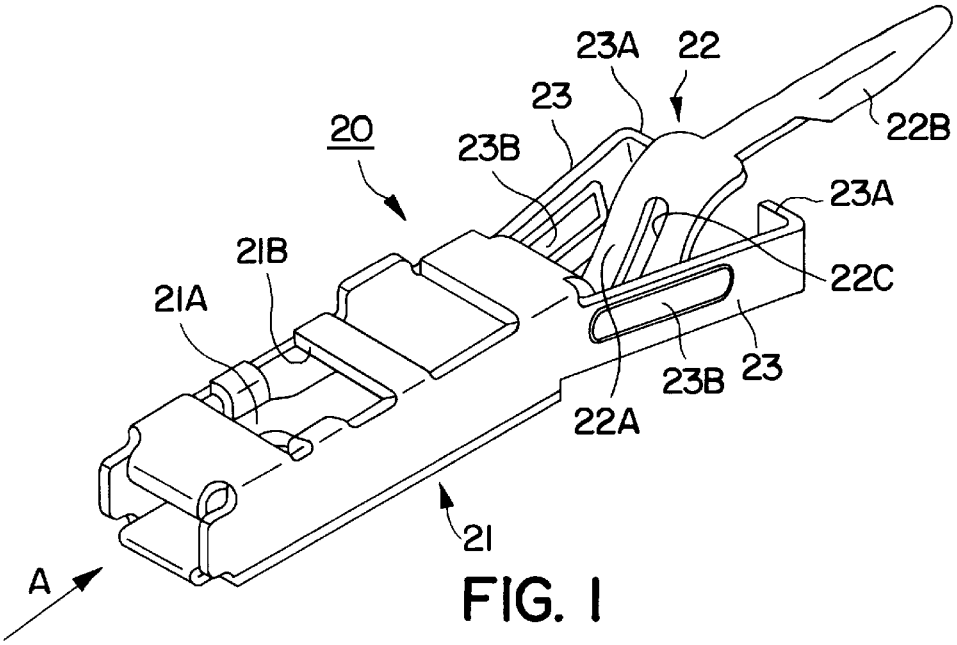
FIG. 1 is a perspective view of a female terminal fitting according to a first embodiment.

Each female terminal fitting 20 is formed at its leading end side (lower left side in FIG. 1) with a substantially rectangular tubular connection portion 21 into which a male terminal fitting (not shown) of a mating terminal fitting is insertable along an insertion direction A. Inside or at the connection portion 21 is provided an elastic contact piece 21A which can be brought into contact with the inserted male terminal fitting. The connection portion 21 also is formed with a lock hole 21B preferably in its upper surface as shown in FIG. 1. When the female terminal fitting 20 is inserted into the terminal cavity 11 of the connector housing 10 from right in FIG. 2, a lance or engaging portion 12 is engaged with the lock hole 21B so as to prevent the female terminal fitting 20 from coming out of the terminal cavity 11. A board connection piece or portion 22, preferably in the form of a strip extending preferably in a direction substantially opposed to the connection portion 21 or backwardly, is connected continuously with the rear end of the upper surface of the connection portion 21. The board connection piece 22 includes a deformation permitting portion 22A which is curved or bent in a direction at an angle different from 0° or 180° with respect to a longitudinal direction of the connector housing 11 or the insertion and/or withdrawal direction A of the male terminal fitting, e.g. substantially downwardly in FIG. 1. The board connection piece 22 also includes a fixing or solder portion 22B which is located adjacent to, and preferably at the rear end of, the deformation permitting portion 22A. The fixing or solder portions 22B is to be inserted into and fixed or soldered with an insertion hole 31 (see FIG. 2) of a printed circuit board 30 or the like electric or electronic equipment. The solder portion 22B is connected with the connection portion 21 via the deformation permitting portion 22A to reduce stress on the solder portion 22B during the insertion and withdrawal of an unillustrated male terminal fitting, by the deformation and/or elongation or change of a longitudinal length of the deformation permitting portion 22A along the insertion/withdrawal direction A. Further, the deformation permitting portion 22A preferably is formed with a slit 22C extending along the length of the board connection piece 22 to enhance a degree of deformation thereof.

At least one, and preferably a pair of elastic holding portions 23 extend from the insertion end of the male terminal fitting into the female terminal fitting 20. More particularly, the elastic holding portions 23 preferably extend backwardly from the opposite sides of preferably the rear end of the connection portion 21 of the female terminal fitting 20, thereby substantially enclosing the board connection piece 22 from substantially opposite sides. The elastic holding portions 23 preferably have substantially L-shaped portions 23A which are bent substantially inwardly toward each other or toward the board connection piece 22. Reinforcing beads or reinforcing crease or dimples 23B extend along the length of the elastic holding portions 23 and bulge inwardly.

Figure 3:
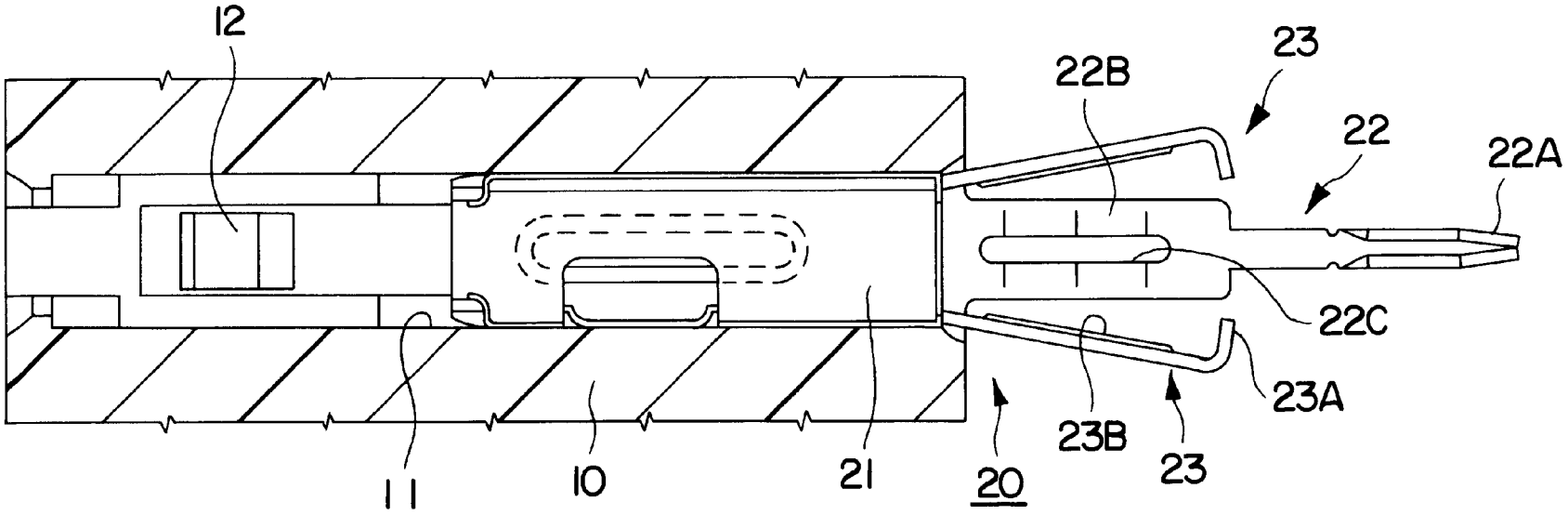
FIG. 3 is a plan view in section of the female terminal fitting being inserted.
Figure 4:
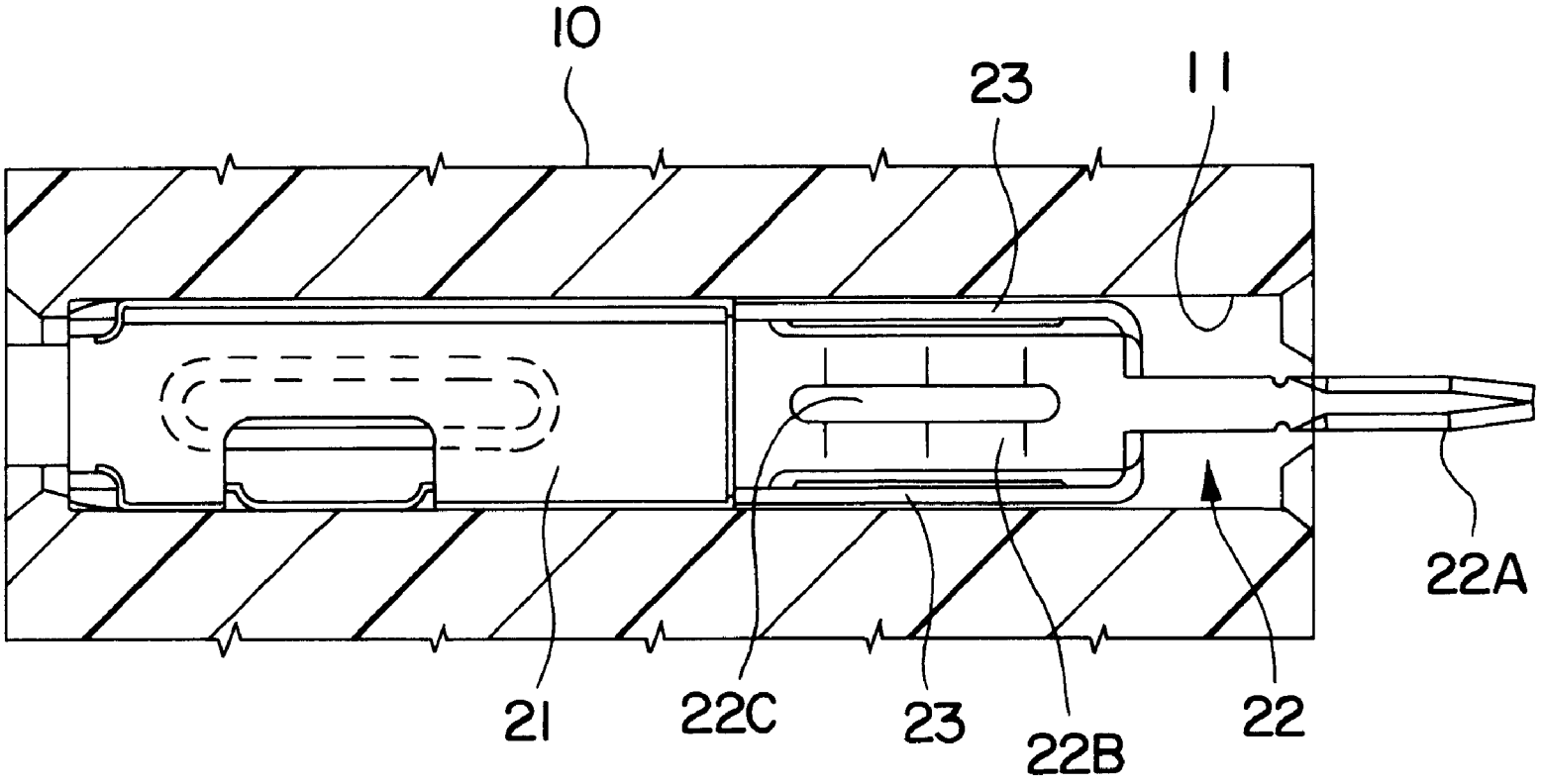
FIG. 4 is a plan view in section of the female terminal fitting mounted in the connector housing.

The aforementioned female terminal fitting 20 is insertable into the corresponding terminal cavity 11 as shown in FIG. 3. During insertion, the elastic holding portions 23 are brought into contact with the inner walls of the terminal cavity 11 and are pushed. The insertion forces cause the elastic holding portions 23 to undergo an elastic and/or plastic deformation in directions toward the board connection piece 22 or toward each other. The terminal fitting 20 is permitted to be further inserted into the terminal cavity 11, and reaches a proper insertion position where the engaging portion 12 is engaged with the lock hole 21B to prevent the female terminal fitting from substantially coming out of the terminal cavity 11.

Figure 2:
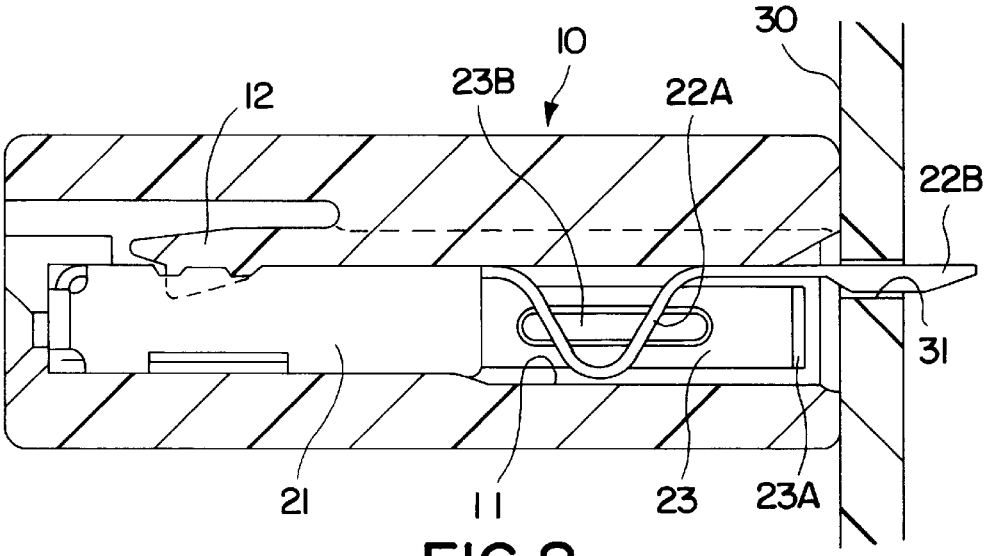
FIG. 2 is a side view in section of the female terminal fitting mounted in a connector housing.

In the mounted state of the terminal fitting 20, the elastic holding portions 23 are in pressing contact with the inner walls of the terminal cavity 11 due to their elastic force, thereby substantially preventing the displacement in a lateral direction of the terminal fitting 20. Accordingly, when this connector is mounted on the printed circuit board 30 as shown in FIG. 2, there is no likelihood that the solder portion 22B of the board connection piece 22 will shake and/or be displaced from or misaligned with respect to the insertion hole 31 so as to strike against the printed circuit board 30. Thus excessive deformation of the deformation permitting portion 22B during when insertion of the female terminal fitting 20 into the terminal cavity 11 can be avoided. As a result, the solder potion 22B can be securely inserted into the insertion hole 31.

Further, since the pair of elastic holding portions 23 substantially face each other in this embodiment, they stretch or substantially extend between the inner walls of the terminal cavity 11, with the result that the female terminal fitting 20 can be stably held in the terminal cavity 11.

Figure 5:
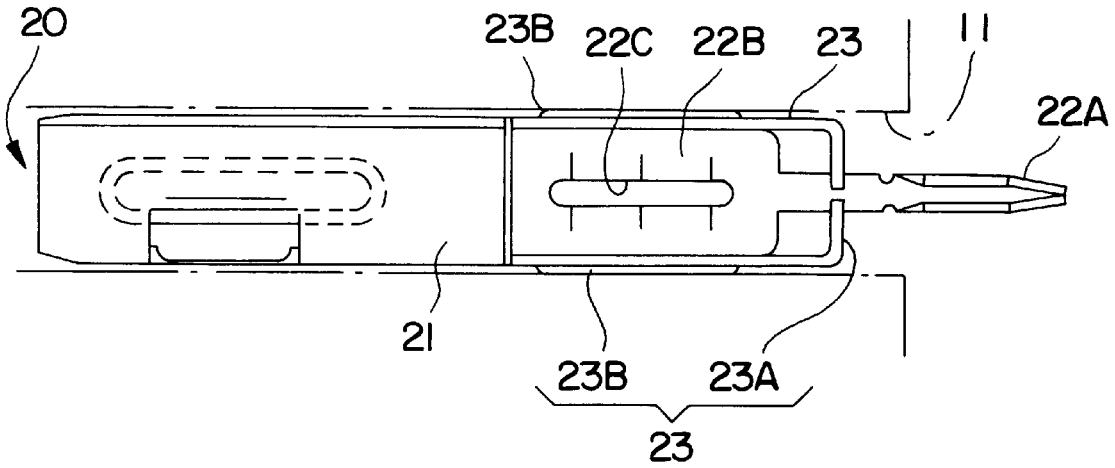
FIG. 5 is a plan view of a terminal fitting according to a second embodiment of the invention.
Figure 6:
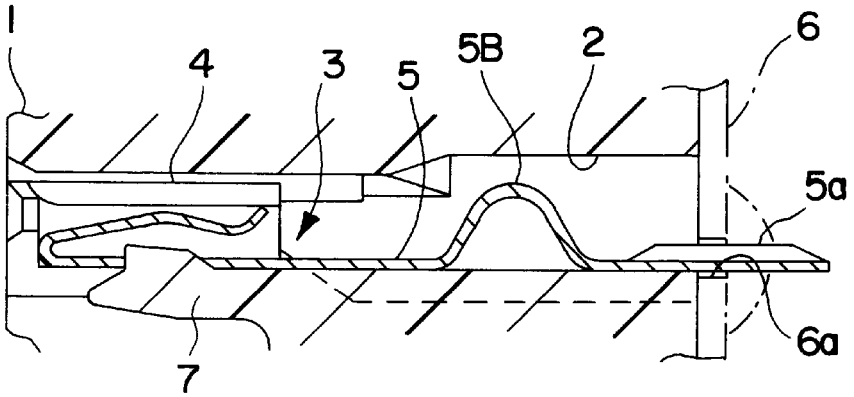
FIG. 6 PRIOR ART
FIG. 6 is a side view in section of a prior art connector.

FIG. 5 shows a second embodiment which differs from the first embodiment substantially in the configuration of the reinforcing beads 23B of the elastic holding portions 23.

Specifically, the reinforcing beads 23B are formed to bulge outward of the elastic holding portions 23 and are brought substantially into contact with the inner walls of the terminal cavity 11 of the connector housing 10.

As a result, the elastic holding portions 23 are brought locally but strongly, into contact with the inner walls of the terminal cavity 11 where the reinforcing beads 23B are formed. Thus, the terminal fitting 20 can be held with a larger force.

The present invention is not limited to the described and illustrated embodiments. For example, the following embodiments are embraced by the technical scope of the present invention as defined in the claims.

Although the invention is applied to the female terminal fitting 20 in the respective embodiments, it may also be applicable to a male terminal fitting.

Although the board connection piece 22 is formed with the bent deformation permitting portion 22A in the foregoing embodiments, it may have a linear configuration.

Besides the following embodiments, a variety of changes can be made without departing the spirit and scope of the present invention as defined in the claims.

What is claimed is:

1. A connector for a printed circuit board, comprising:

a connector housing formed from a non-conductive material and having a board mounting end, an opposed mating end and at least one terminal cavity extending therebetween, said cavity being defined by at least one pair of opposed inner wall surfaces, the connector housing including an engaging portion projecting into the terminal cavity; and at least one terminal fitting securely mounted respectively in the terminal cavity, the terminal fitting being unitarily formed from a conductive metal and having a mating end and a board mounting end, a connection portion formed at the mating end of the terminal fitting and being disposed in proximity to the mating end of the connector housing, the connection portion comprising a top wall, a bottom wall opposed to the top wall and a pair of opposed side walls extending between the top and bottom walls to define a receptacle extending into the mating end of the terminal fitting for connection with a mating terminal fitting along a mating direction, at least one lock hole formed in the terminal fitting, the lock hole being engageable by the engaging portion of the connector housing for limiting movement of the terminal fitting in a direction extending between the board mounting end and the mating end of the connector housing, a board connection piece extending from the top wall of the connection portion to the board mounting end of the terminal fitting, the board connection piece comprising a bent deformation-permitting portion adjacent the connection portion and a solder portion extending from the board mounting end of the terminal fitting toward the deformation permitting portion, the solder portion projecting beyond the board mounting end of the connector housing for connection with the printed circuit board, the bent deformation-permitting portion being bent about a plurality of axes aligned perpendicular to the mating direction for facilitating deformation and avoiding stress on regions of the board connection piece secured to the printed circuit board, the deformation-permitting portion being formed with a slit aligned substantially parallel to the mating direction for further facilitating deformation, and a pair of elastic holding portions extending deflectably and unitarily from the respective side walls of the connection portion for deflection about axes aligned perpendicular to the mating direction and perpendicular to the axes about which the deformation permitting portion is bent, the elastic holding portions being disposed on opposite respective sides of the bent deformation permitting portion and having ends bent towards one another at a location between the bent deformation permitting portion and the solder portion of the board connection piece, said ends of said elastic holding portions defining a width, in an unbiased condition, exceeding a width of the connection portion, such that said elastic holding portions can be biased against the opposed inner walls of the terminal cavity for urging the terminal fitting into a substantially central position between said opposed inner walls of the terminal cavity and such that said elastic holding portions limit deformation of the terminal fitting toward the circuit board.

2. A connector according to claim 1, wherein the elastic holding portion is formed with at least one bead which is engageable with the inner wall of the corresponding terminal cavity.

3. A connector according to claim 1, wherein the deformation-permitting portion has a slit formed therein for facilitating deformation.

* * * * *